United States Patent [19]

Pedersen

[11] 4,010,746

[45] Mar. 8, 1977

[54] REGULATOR WITH WATER FILL MECHANISM TO PREVENT FREE FLOW

[75] Inventor: Vernon G. Pedersen, Chicago, Ill.

[73] Assignee: Dacor Corporation, Northfield, Ill.

[22] Filed: Aug. 25, 1971

[21] Appl. No.: 174,618

[52] U.S. Cl. ..... 128/147; 128/142.2

[51] Int. Cl.[2] ..... A62B 7/04

[58] Field of Search ..... 128/142, 142.4, 142.5, 128/142.6, 142.7, 147; 137/63 R, 494

[56] References Cited

UNITED STATES PATENTS

| | | | |
|---|---|---|---|
| 2,747,572 | 5/1956 | Gagnan | 128/147 |
| 3,095,890 | 7/1963 | Cousteau et al. | 137/63 R |
| 3,147,499 | 9/1964 | Nelson et al. | 128/147 X |
| 3,147,752 | 9/1964 | Cousteau et al. | 128/147 |
| 3,329,158 | 7/1967 | Geiszler | 128/142 X |

*Primary Examiner*—Robert W. Michell
*Assistant Examiner*—Lee S. Cohen
*Attorney, Agent, or Firm*—Edmond T. Patnaude

[57] ABSTRACT

The inhalation tube of a pressure regulator is divided by means of a baffle curved at its inner end adjacent the side wall of the chamber so that when the regulator is in the water with the mouthpiece open, water is channeled into the regulator chamber through the inhalation tube along one side of the baffle and air flows out through the tube along the other side of the baffle.

5 Claims, 2 Drawing Figures

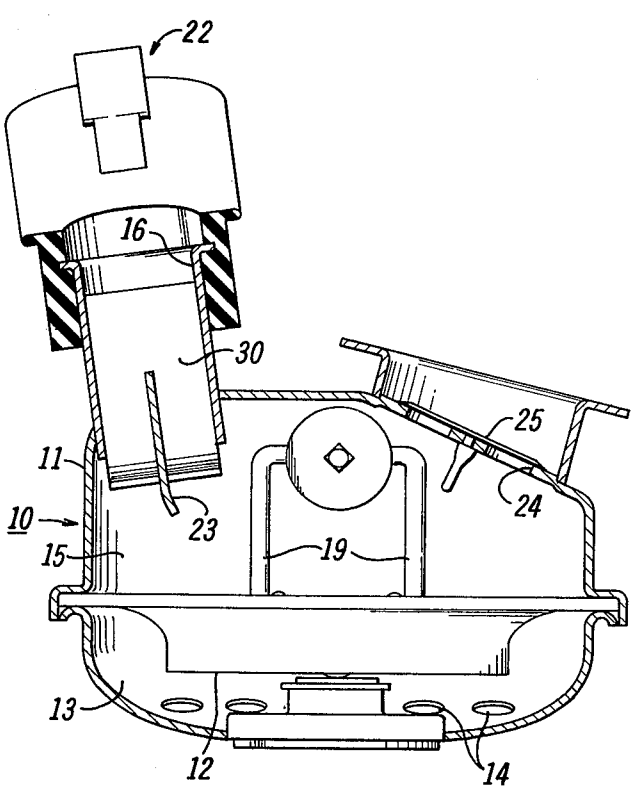
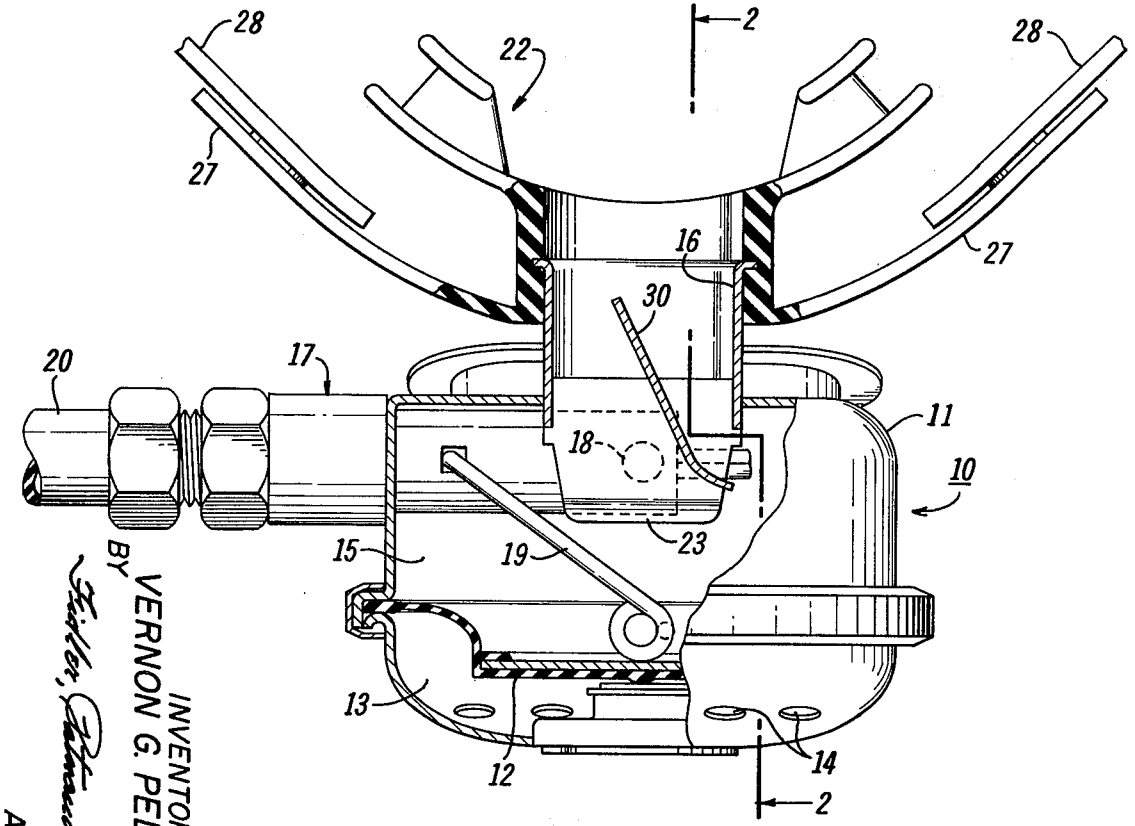
INVENTOR
VERNON G. PEDERSEN
BY
Fidler, Patrancede & Hayes
ATTORNEYS

REGULATOR WITH WATER FILL MECHANISM TO PREVENT FREE FLOW

The present invention in general relates to a self-contained underwater breathing apparatus, and it relates more particularly to a second-stage regulator having novel and improved means therein for inhibiting the free flow of air through the regulator when it is removed from the diver's mouth under water.

In underwater breathing apparatus of the two stage single hose type, a first stage regulator is generally mounted on the air supply tank and connected to the second stage regulator by a flexible hose. The mouthpiece is mounted directly on the second-stage regulator which is so designed and adjusted as to minimize the breathing effort, while providing the diver with control of the air supplied to him. This is commonly achieved by a slight venturi action which holds the control diaphragm in a valve open position once the diver has breathed in to open the valve and initiate air flow through the regulator. When, of course, the diver exhales through the mouthpiece, the venturi action is overcome and the valve closes.

A problem with such regulators has been that when the diver spits out the mouthpiece while the valve is open, the venturi action maintains the valve in the open condition and bubbles of air are emitted from the mouthpiece. While experienced divers recognize this condition and know that it is readily stopped by simply placing the hand over the mouthpiece to stop the flow of air therethrough, it is frightening to novices and others who are not aware of it.

Therefore, an object of the present invention is to provide new and improved means for preventing the free flow of air through a regulator immersed in water.

Another object of this invention is to provide such a means which is easily incorporated in second-stage underwater regulators.

Briefly, the above and further objects may be realized, in accordance with the teachings of the present invention, by incorporating in the mouthpiece tube of the regulator means for channeling water into the regulator chamber when the mouthpiece is immersed in water, thereby to fill the chamber with water which interrupts the venturi action and permits the inlet valve to close. In a preferred embodiment of the invention, this means consists of a partition extending substantially throughout the length of the mouthpiece tube so that, when the open end of the mouthpiece is underwater and the inlet valve is open, water flows into the regulator chamber along one side of the partition while air flows out along the other side. The inner end of the partition is curved toward the side of the regulator to block the direct flow of air along one side thereof from the air inlet orifice and to direct the water along the side and bottom of the regulator chamber.

Further objects and advantages and a better understanding of the invention may be had from the following detailed description taken in connection with the accompanying drawing, wherein:

FIG. 1 is a side elevational view, partly broken away of a second stage regulator embodying the present invention; and FIG. 2 is a sectioned view of the regulator of FIG. 1 taken along the line 2—2 thereof.

Referring now to the drawing, a second stage regulator 10 comprises as its principal elements a housing 11; a diaphragm 12 dividing the chamber therein into a first compartment 13 open to the ambient through a plurality of openings 14 and a second compartment 15; a mouthpiece tube 16; an air inlet tube 17 having an air inlet orifice 18 within the compartment 15; a valve (not shown) within the tube 17; and a lever 19 interconnected between the diaphragm 12 and the air inlet valve to open the valve in response to movement of the diaphragm 12 into the compartment 15. A flexible air hose 20 is connected between the tube 17 and a first stage regulator (not shown) mounted on an air supply tank. A mouthpiece 22 is tightly fitted over the tube 16. An air deflector baffle 23 is mounted in the inner end portion of the mouthpiece tube 16 and extends a substantial distance into the compartment 15 directly opposite to the orifice 18. An outlet port 24 is covered by a resilient check valve 25 through which the diver exhales but which prevents water from entering the compartment 15. As thus far described, the regulator 10 is substantially the same as that disclosed in copending application 823,420 filed on May 9, 1969 and assigned to the same assignee as the present invention.

In normal use, when the diver holding the mouthpiece 22 in his mouth inhales, the pressure in the compartment decreases below the ambient pressure in the compartment 14 whereby the diaphragm 12 moves into the compartment 15 to open the inlet valve whereby air flows out of the orifice 18 toward the baffle 23 and through the mouthpiece tube 16 to the diver's lungs. The air flowing directly into the tube 16 causes a slight venturi action which maintains the pressure in the compartment 15 below that in compartment 14 whereby the inlet valve remains open without requiring the diver to continue to consciously breath in. When the diver exhales, the pressure in the compartment 15 increases whereby the diaphragm 12 moves out to permit the bias spring in the air inlet valve assembly to close the valve and interrupt the flow of air from the orifice 18. The check valve 25 then opens so that the exhaust gases from the diver's lungs are released into the ambient water.

The mouthpiece 22 includes a strap like section 27 which is adapted to be connected to a band 28 which fits around the diver's head to help support the regulator 10. Accordingly, when the diver spits out the mouthpiece 22 the regulator falls toward his chest into approximately the position illustrated in FIGS. 1 and 2 with the mouthpiece tube 16 in a substantially vertical position. In order to permit water to fill the compartment 15, a partition 30 is mounted in the mouthpiece tube 16 to provide a channel along one side of the tube 16 through which water may enter the compartment, and a channel along the other side of the tube 16 through which air exits from the compartment 15. The partition 30 extends in a direction transverse to the central longitudinal axis of the tube 16 and has a curved inner end extending substantially parallel to the diaphragm 12. As shown in FIG. 1, the partition 30 deflects air from the orifice 18 to the left side of the partition and directs water along the right side thereof into the compartment 15. As the compartment 15 begins to fill with water, the diaphragm 12 moves downwardly out of the compartment 15 whereby the air inlet valve closes to interrupt the flow of air through the regulator 10.

While the present invention has been described in connection with a particular embodiment thereof, it will be understood that those skilled in the art may make many changes and modifications without departing from the true spirit and scope thereof. Accordingly, the appended claims are intended to cover all such changes and modifications as fall within the true spirit and scope of the present invention.

What is claimed is:

1. A pressure regulator for use in underwater breathing apparatus, said regulator including a housing; a diaphragm dividing the housing into a first compartment open to the ambient and a second compartment from which extends a mouthpiece tube through which the user breathes; an air inlet orifice opening into said second compartment; a valve for controlling the flow of air to said orifice; and means connecting said valve to said diaphragm for opening the valve when a pressure differential of at least a predetermined amount is provided between said first and second compartments, the invention being characterized by means for channeling water into said second compartment through a portion of said mouthpiece tube when said valve is open and said regulator is immersed in water with said tube open to the water to cause said valve to close, said means for channeling comprising a partition disposed in said mouthpiece tube and extending a substantial distance from within said second compartment into said tube and dividing said tube into two adjacent passageways respectively opening into said second compartment, and the inner end of said partition being offturned away from said orifice over one of said passageways to reduce the air flow from said orifice through said one of said passageways to permit water to flow therethrough into said second compartment while said valve is open.

2. A pressure regulator according to claim 1 wherein said partition extends transversely to the longitudinal axis of said mouthpiece tube.

3. A pressure regulator according to claim 1 wherein said offturned end of said partition extends substantially parallel to said diaphragm.

4. A pressure regulator for use in underwater breathing apparatus, said regulator including a housing; a diaphragm dividing the housing into a first compartment open to the ambient and a second compartment from which extends a mouthpiece tube through which the user breathes; an air inlet orifice opening into said second compartment; a valve for controlling the flow of air to said orifice; and means connecting said valve to said diaphragm for opening the valve when a pressure differential of at least a predetermined amount is provided between said first and second compartments, the invention being characterized by a partition disposed in said mouthpiece tube and extending a substantial distance from within said second compartment into said tube and dividing said tube into two adjacent passageways respectively opening into said second compartment, the inner end of said partition being offturned away from said orifice over one of said passageways to reduce the air flow from said orifice through said one of said passageways to permit water to flow therethrough into said second compartment while said valve is open, and an air deflector baffle mounted in said mouthpiece and extending into said second compartment opposite said orifice, said baffle lying perpendicular to said partition.

5. A pressure regulator according to claim 4 wherein said orifice is positioned to direct air directly against said baffle on said one side of said partition.

* * * * *

UNITED STATES PATENT AND TRADEMARK OFFICE

CERTIFICATE OF CORRECTION

PATENT NO. : 4,010,746

DATED : March 8, 1977

INVENTOR(S) : Vernon G. Pedersen

It is certified that error appears in the above-identified patent and that said Letters Patent are hereby corrected as shown below:

Column 2, line 24, after "compartment" insert 15;

line 25, change "14" to -13-;

line 31, change "14" to -13-.

Signed and Sealed this

Twenty-eighth Day of June 1977

[SEAL]

*Attest:*

RUTH C. MASON
*Attesting Officer*

C. MARSHALL DANN
*Commissioner of Patents and Trademarks*